US008413667B2

(12) United States Patent
Kuglen et al.

(10) Patent No.: US 8,413,667 B2
(45) Date of Patent: Apr. 9, 2013

(54) HAIR COMB AND DUAL COMB HAIR ACCESSORY HAVING SAME

(75) Inventors: Francesca Kuglen, Oakland, CA (US); Holliday Montgomery, Lynchburg, TN (US)

(73) Assignee: Sennits, LLC, Oakland, CA (US)

( * ) Notice: Subject to any disclaimer, the term of this patent is extended or adjusted under 35 U.S.C. 154(b) by 252 days.

(21) Appl. No.: 12/606,119

(22) Filed: Oct. 26, 2009

(65) Prior Publication Data

US 2010/0132729 A1 Jun. 3, 2010

Related U.S. Application Data

(60) Provisional application No. 61/108,467, filed on Oct. 24, 2008.

(51) Int. Cl.
*A45D 24/04* (2006.01)

(52) U.S. Cl. ..... 132/218; 132/273

(58) Field of Classification Search ..... 132/60, 132/61, 64.1, 101, 105, 107, 126, 128, 130, 132/146, 148, 219, 273, 275, 129, 131, 155, 132/154; D28/21, 32, 39, 41
See application file for complete search history.

(56) References Cited

U.S. PATENT DOCUMENTS

| | | | | | |
|---|---|---|---|---|---|
| 184,793 | A | | 11/1876 | Morse | |
| 691,946 | A | | 1/1902 | Kingman | |
| 715,600 | A | | 12/1902 | Pomeroy | |
| 778,467 | A | * | 12/1904 | Tojetti | 132/144 |
| 792,266 | A | * | 6/1905 | Hooper | 132/101 |
| 794,828 | A | * | 7/1905 | Winn | 132/160 |
| 852,273 | A | * | 4/1907 | Hess | 132/128 |
| 859,098 | A | | 7/1907 | Mintzer | |
| 904,566 | A | | 11/1908 | Schwab | |
| D39,675 | S | * | 12/1908 | Newton | D28/33 |
| 952,491 | A | * | 3/1910 | Youngs | 132/159 |
| 964,494 | A | * | 7/1910 | Cranmer | 132/129 |
| 966,113 | A | * | 8/1910 | McGall | 132/128 |
| 973,361 | A | | 10/1910 | Lynch | |
| 1,152,884 | A | | 9/1915 | Damon | |
| 1,239,951 | A | * | 9/1917 | Peckham | 132/148 |
| 1,512,272 | A | | 10/1924 | Burnet | |
| 1,540,102 | A | | 6/1925 | Cohen | |
| 1,635,065 | A | | 7/1927 | Watson | |
| 1,638,442 | A | * | 8/1927 | Jayne et al. | 132/129 |
| 1,640,429 | A | * | 8/1927 | Speer | 132/144 |
| 1,665,380 | A | | 4/1928 | Ruffio | |

(Continued)

FOREIGN PATENT DOCUMENTS

| | | |
|---|---|---|
| FR | 594906 | 3/1925 |
| WO | WO9806295 | 2/1998 |
| WO | WO2010048634 | 4/2010 |

*Primary Examiner* — Robyn Doan
*Assistant Examiner* — Tatiana Nobrega
(74) *Attorney, Agent, or Firm* — Beeson Skinner Beverly, LLP

(57) ABSTRACT

An improved hair comb for a dual comb hair accessory (11) or the like which has strand connections or terminations. The comb includes a spine (17) having a raised portion (19, 21, 23) that can advantageously be used to relocate or reorient strand connections to the comb or combs of the hair accessory relative to the plane of the comb, and that can provide a structure into or behind which strand connections, terminations and/or segments can be tucked. Preferably, the raised spine portions of the combs are constructed to form a raised cavity region (27) in the spine for receiving strand connections, terminations and/or segments.

13 Claims, 10 Drawing Sheets

U.S. PATENT DOCUMENTS

| | | | | | |
|---|---|---|---|---|---|
| 1,679,653 | A | * | 8/1928 | Eberhart | 132/128 |
| 1,695,986 | A | * | 12/1928 | Stacey | 132/129 |
| 1,823,361 | A | | 9/1931 | Hudson | |
| 1,841,475 | A | * | 1/1932 | Greenwich | 132/128 |
| 1,991,291 | A | * | 2/1935 | Parr | 132/144 |
| 2,029,792 | A | * | 2/1936 | Pluchino | 132/150 |
| D103,677 | S | * | 3/1937 | Foster | D28/33 |
| 2,139,106 | A | * | 12/1938 | Solomon | 132/144 |
| 2,312,813 | A | | 3/1943 | Goldstein | |
| 2,386,682 | A | | 11/1944 | Heineman | |
| D139,693 | S | * | 12/1944 | Motley | D28/32 |
| 2,384,013 | A | * | 9/1945 | Caldora | 132/157 |
| 2,533,067 | A | * | 12/1950 | Taren et al. | 132/136 |
| 2,604,101 | A | * | 7/1952 | Helfgott | 132/144 |
| D178,334 | S | | 7/1956 | Behr | |
| D179,754 | S | | 2/1957 | Behr | |
| D183,654 | S | | 11/1958 | Hambric | |
| 3,099,271 | A | | 7/1963 | Dubelier | |
| 3,120,852 | A | | 2/1964 | Sawyer | |
| 3,234,952 | A | * | 2/1966 | Endter et al. | 132/243 |
| 4,254,783 | A | | 3/1981 | Kim | |
| D272,861 | S | | 2/1984 | Incando | |
| 4,522,215 | A | * | 6/1985 | Verducci | 132/219 |
| D316,161 | S | | 4/1991 | Kuglen | |
| 5,174,312 | A | | 12/1992 | Adams | |
| D334,793 | S | | 4/1993 | Richardson | |
| 5,379,782 | A | | 1/1995 | Tabb | |
| 5,622,194 | A | | 4/1997 | Ledda-Vengerder | |
| 5,690,128 | A | | 11/1997 | Grimes | |
| 5,732,720 | A | | 3/1998 | Sears | |
| 5,826,593 | A | | 10/1998 | Haubrich | |
| D419,264 | S | | 1/2000 | Wallon et al. | |
| 6,047,705 | A | * | 4/2000 | Hawley | 132/128 |
| D425,248 | S | | 5/2000 | Hawley | |
| 6,123,086 | A | * | 9/2000 | Kuglen | 132/275 |
| D439,014 | S | | 3/2001 | Pender | |
| D451,246 | S | | 11/2001 | Zuckerman | |
| D483,522 | S | | 12/2003 | Leslie | |
| 7,013,900 | B2 | * | 3/2006 | Silva | 132/200 |
| 7,506,653 | B2 | * | 3/2009 | Gladwin et al. | 132/128 |
| 7,631,649 | B2 | * | 12/2009 | Coral et al. | 132/277 |
| D615,244 | S | * | 5/2010 | Hsu | D28/32 |
| 2003/0168072 | A1 | * | 9/2003 | Valdez | 132/148 |
| 2005/0199255 | A1 | * | 9/2005 | Silva | 132/144 |
| 2008/0283074 | A1 | * | 11/2008 | Gladwin et al. | 132/126 |
| 2010/0192967 | A1 | * | 8/2010 | Gladwin | 132/126 |

* cited by examiner

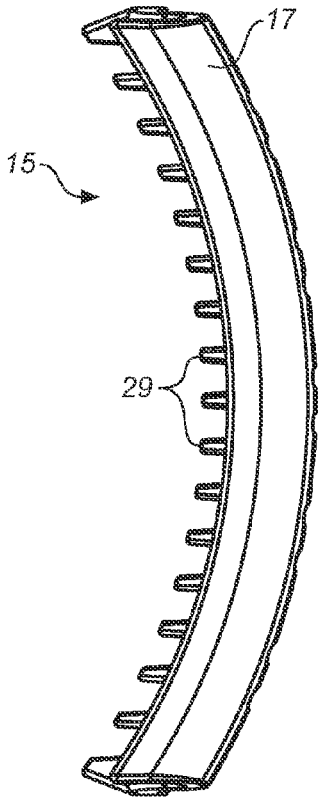
FIG. 7
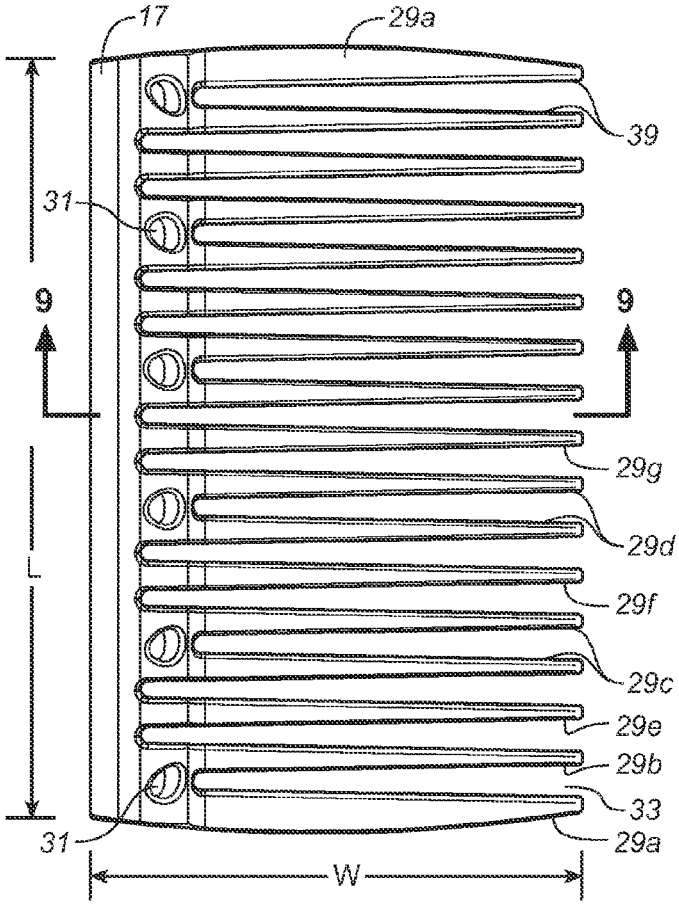
FIG. 6
FIG. 8
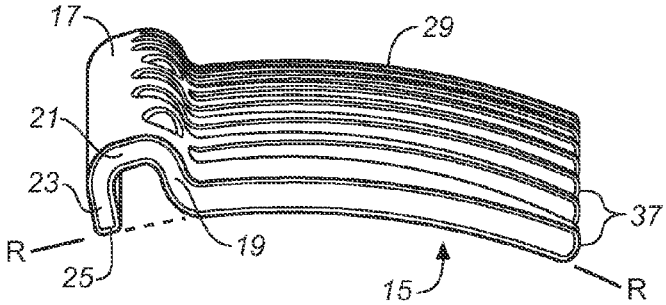
FIG. 9
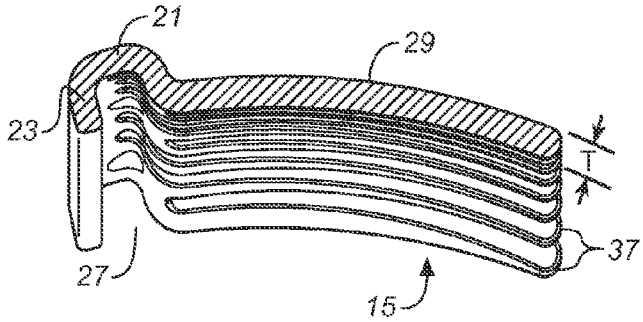

FIG. 15
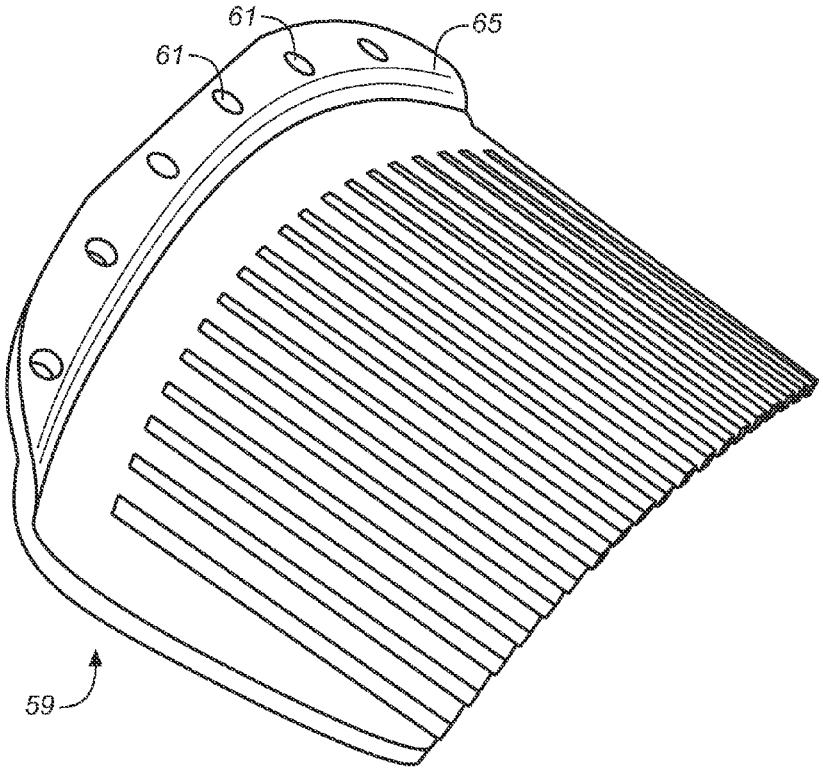
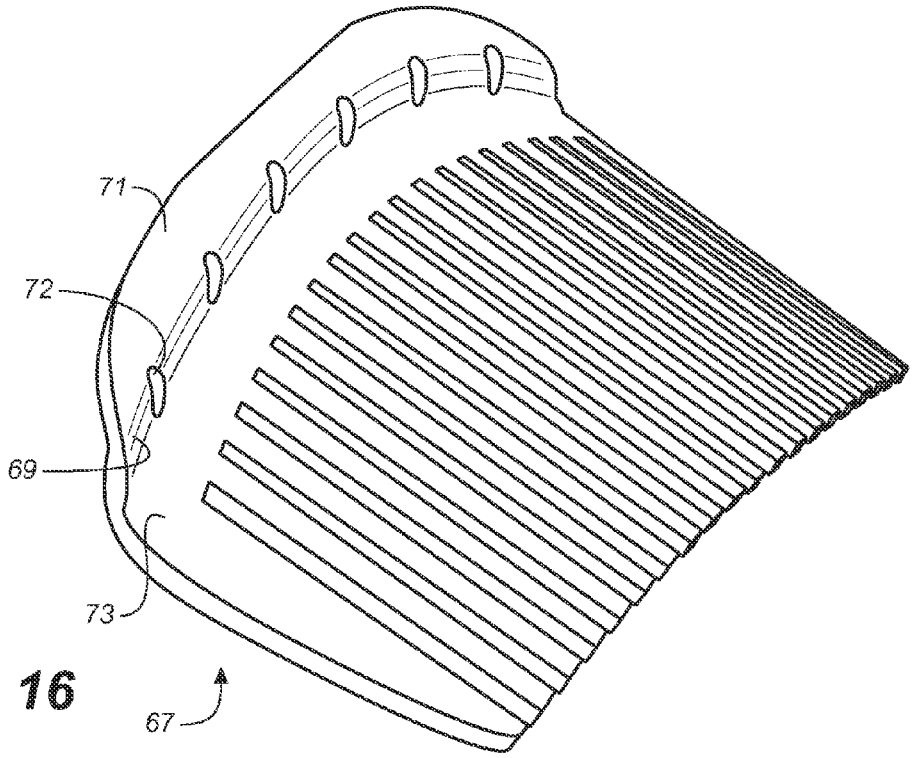
FIG. 16

HAIR COMB AND DUAL COMB HAIR ACCESSORY HAVING SAME

CROSS-REFERENCE TO RELATED APPLICATIONS

This application claims the benefit of U.S. Provisional application Ser. No. 61/108,467 filed Oct. 24, 2008.

BACKGROUND OF THE INVENTION

The present invention generally relates to hair accessories which employ hair combs and strands of material, typically elastic strands, which are attached to the spines of the hair combs. The invention more particularly relates to the combs used in such hair accessory products.

Hair accessory products are used to style and decorate a woman's hair. In one widely used type of hair accessory product, referred to herein as a "dual comb hair accessory," elastic strands of material are attached to and interconnect the spines of two opposed combs. The opposed combs are pulled apart so that the elastic strands are stretched, and then the combs are folded under and inserted into the hair to retain the hair in a desired position. Often, the elastic strands, which can be parallel, braided, intertwined or crisscrossed, are beaded or fabric covered to provide a decorative element to the accessory.

Plastic combs are often used for dual comb hair accessory products. An example is found in U.S. Pat. No. 6,123,086, which discloses a dual comb hair accessory having plastic combs interconnected by fabric covered elastic bands. However, use of conventional plastic combs involves a number of difficulties. First, the spine of the comb is by necessity relatively wide in order to provide sufficient strength and thickness of material for the attachment openings for the accessory's elastic elements. The large spines create a relatively bulky comb, which is noticeable in the hair and which is not aesthetically pleasing. Further, when worn, attachment of the elastic strands to strand openings on the flat spines of the combs tends to lift the spine of the combs from the head, thereby creating stability problems. Still further, the connections of the elastics on the underside of the comb, such as knots or other forms of attachment, can create pressure points between the comb and the scalp, causing discomfort to the wearer. These connections can also cause the spine to perch up on the wearer's head, thereby exacerbating the stability problem. Still further the gathering of strand connections underneath the spine can sometimes stick out from underneath the spine, creating an unsightly look that detracts from the desired ornamental appearance of the accessory.

The present invention provides an improved hair comb that overcomes the problems associated with conventional plastic combs used with dual comb hair accessories. The improved hair comb of the invention offers greater stability for the hair accessory, and when worn, permits strand connections behind the spine to be displaced from areas where they can sometimes be seen and cause discomfort. The present invention also provides a comb having a relatively unobtrusive comb spine that is more aesthetically pleasing yet durable. Other advantages of the present invention will be readily apparent from the following specification and claims.

SUMMARY OF THE INVENTION

The invention is directed to a hair comb to which strands, and typically elastic strands, can be attached. The comb includes a spine having a raised portion that can advantageously be used to relocate and/or reorient strand connections (such as knots and/or attachment mechanisms and/or strand segments running behind the spine) relative to the plane of the comb, and that can provide a structure into or behind which such strand connections can be tucked. Preferably, the raised spine portion of the comb is constructed to form a raised cavity region in the spine for receiving the strand segments, connections or terminations.

In another aspect of the invention, a dual comb hair accessory is comprised of opposed combs, each of which has a raised spine, and strands interconnecting the combs. The strand segments, connections or terminations are tucked behind or into a cavity region in the raised spines of the opposed combs. Preferably, the strand openings are provided on the raised portion of the spines of the combs, such that strand-spine connections at the strand openings are elevated relative to the plane of the comb. From this elevated position, the pulling forces which are exerted on the combs by the tensioned strands when the combs are pulled apart are exerted from a higher location on the combs than is the case with conventional combs.

DESCRIPTION OF THE DRAWINGS

FIG. 6 is a top plan view thereof.

FIG. 7 is a rear elevational view thereof.

FIG. 8 is a side elevational view thereof.

FIG. 9 is a cross-sectional view thereof taken along lines 9-9 in FIG. 6.

FIG. 15 is a top front perspective view of further embodiment of an improved hair comb in accordance with the present invention.

FIG. 16 is a top perspective view of yet another embodiment a hair comb in accordance with the present invention.

DETAILED DESCRIPTION OF THE ILLUSTRATED EMBODIMENT

Figure 1:
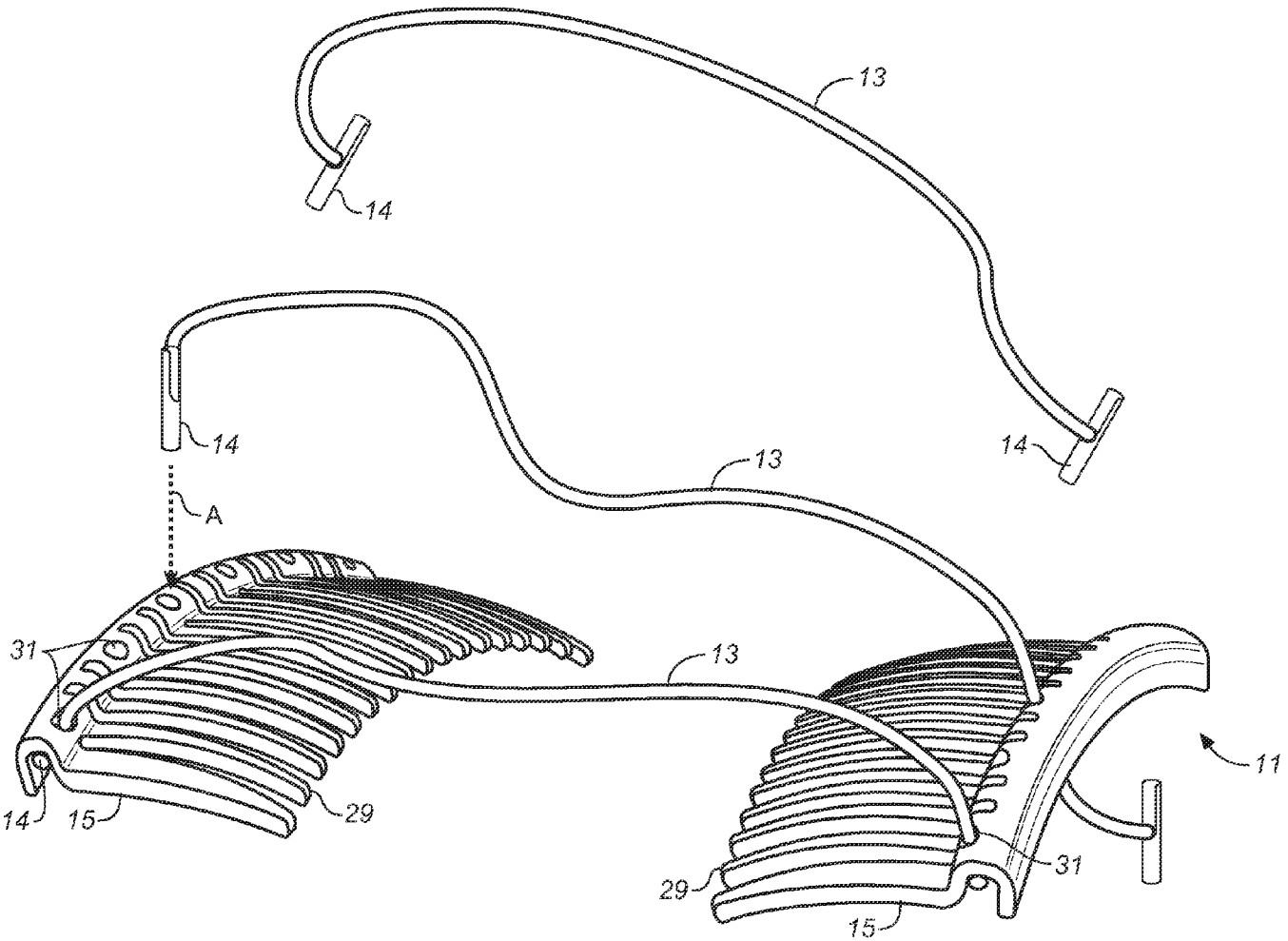
FIG. 1 shows a dual comb hair accessory using two improved hair combs in accordance with the present invention, wherein strands that connect the combs are removably attached to the combs using a T-pin attachment mechanism.
Figure 2:
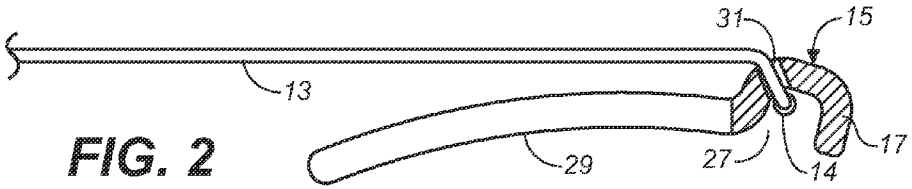
FIG. 2 is a cross-sectional view of one comb of the dual hair accessory shown in FIG. 1 (and taken along lines 2-2 in FIG. 3) after the connecting strands have been attached to the combs of the hair accessory.
Figure 3:
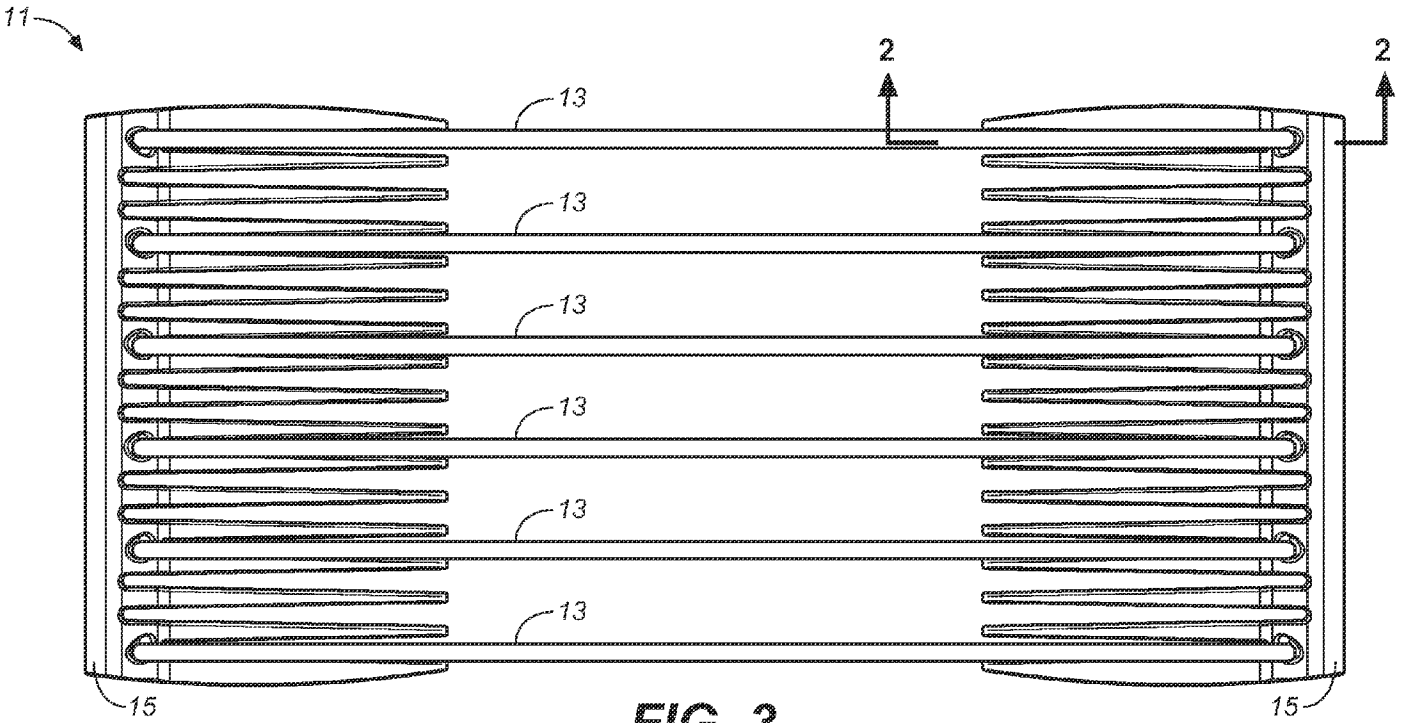
FIG. 3 is a top plan view of the dual comb hair accessory shown in FIGS. 1 and 2 after the strands of material have been attached to the combs, and showing a parallel strand pattern.
Figure 3A:
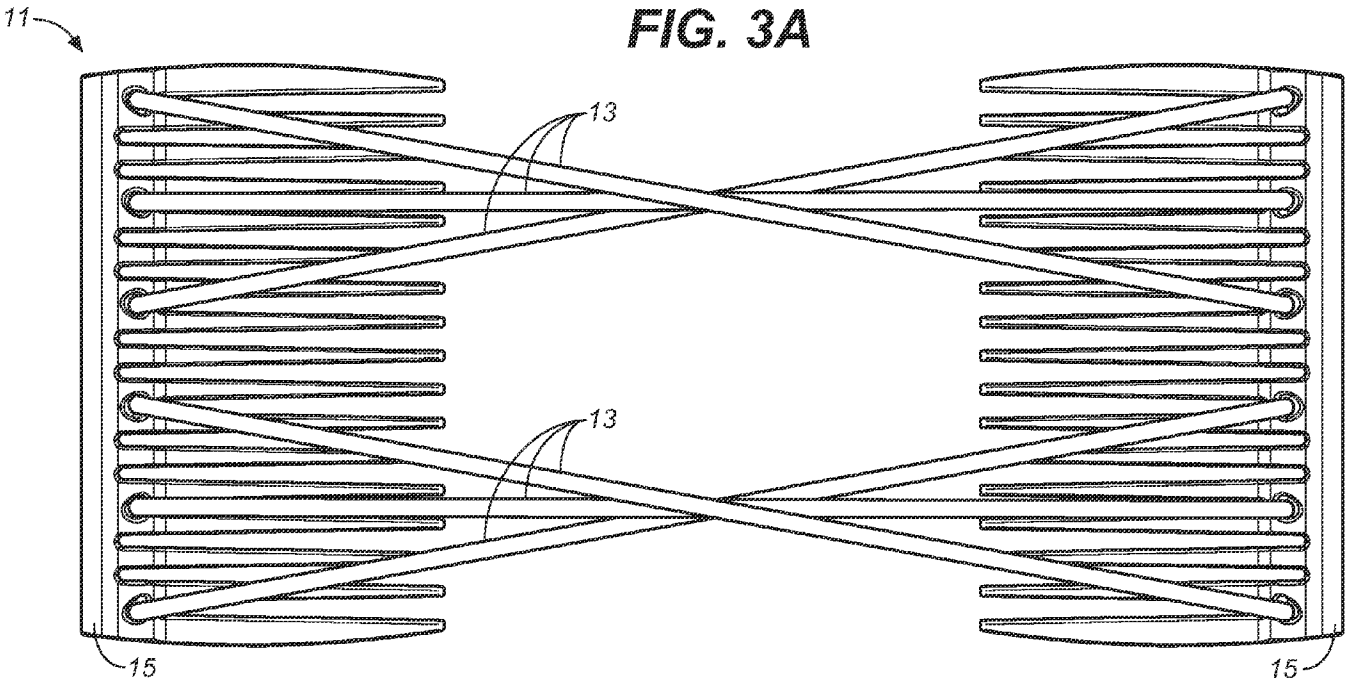
FIG. 3A is a top plan view of the dual comb hair accessory shown in FIGS. 1 and 2 after the connecting strands have been threaded through the combs, and showing a exemplary crisscross strand pattern.
Figure 4:
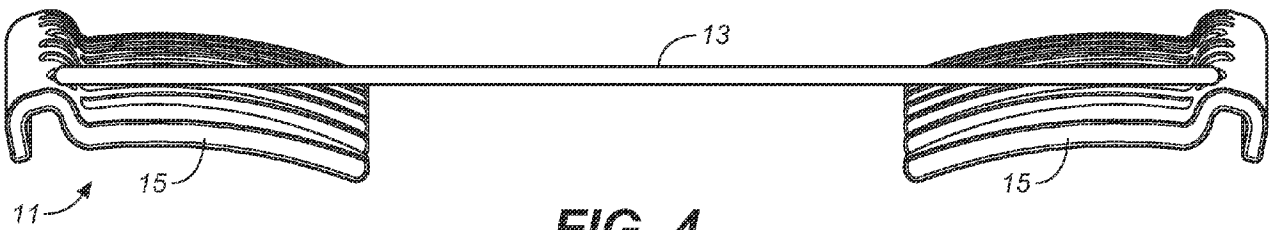
FIG. 4 is a side elevational view of the dual comb hair accessory as shown in FIG. 3.
Figure 5A:
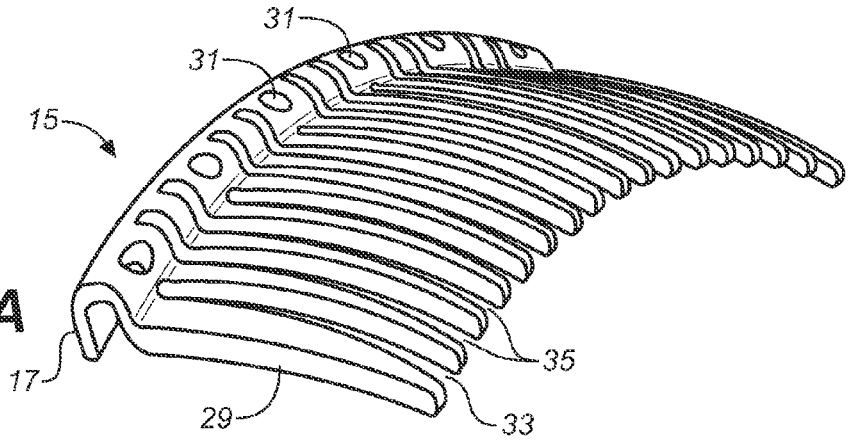
FIG. 5A is a top front perspective view of the improved hair comb shown in FIGS. 1-4.
Figure 5B:
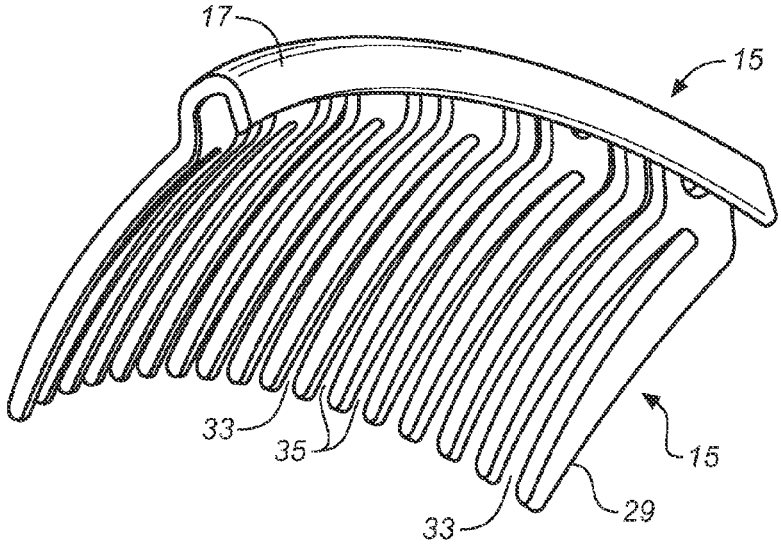
FIG. 5B is a bottom perspective view thereof.
Figure 5C:
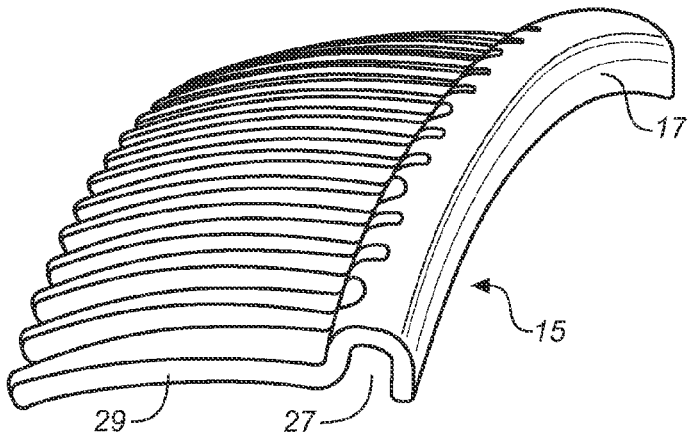
FIG. 5C is a top rear perspective view thereof.
Figure 10A:
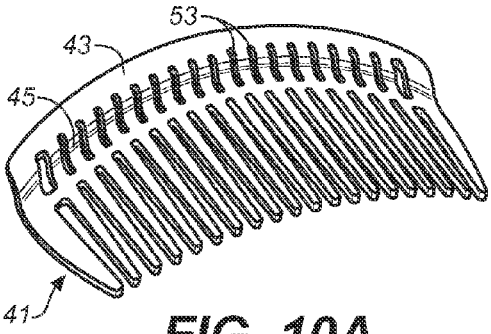
FIG. 10A is a top front perspective view of another embodiment of an improved hair comb in accordance with the present invention.
Figure 10B:
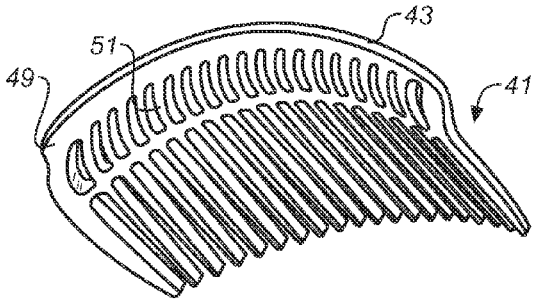
FIG. 10B is a bottom rear perspective view thereof.
Figure 12:
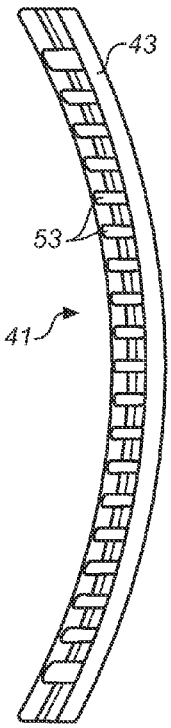
FIG. 12 is a rear elevational view thereof.
Figure 11:
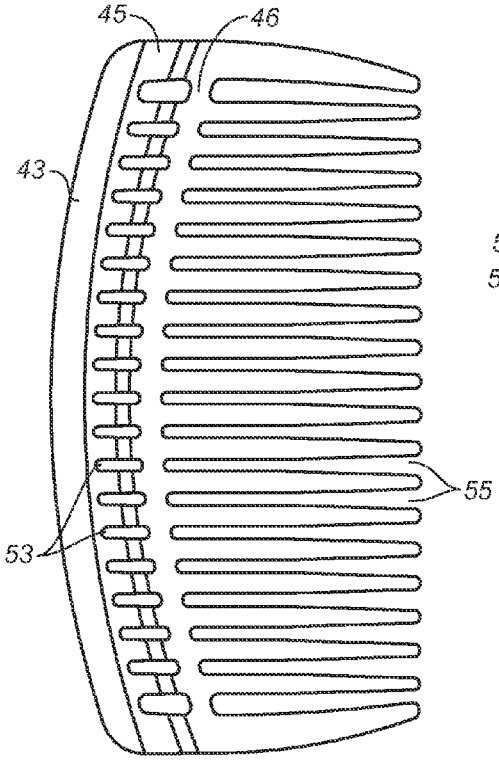
FIG. 11 is a top plan view thereof.
Figure 13:
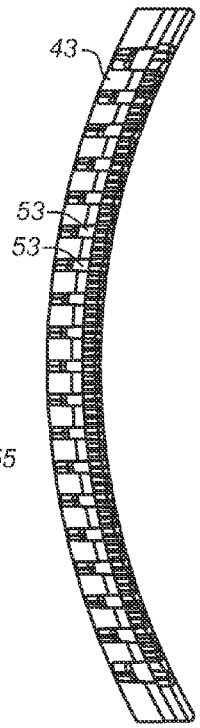
FIG. 13 is a front elevational view thereof.
Figure 14:
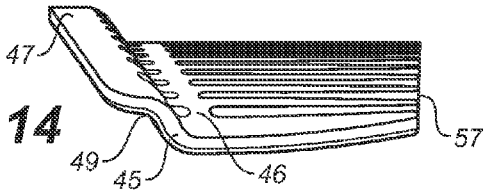
FIG. 14 is a side elevational view thereof.

Referring now to the drawings, FIGS. 1-4 show a dual comb hair accessory 11 having a plurality of strands 13 extending between and connecting opposed combs 15 in a manner that allows the opposed combs to be folded underneath the strands, as best illustrated in FIGS. 2 and 4. The connecting strands are preferably fabricated of a stretchable elastic material, such that the opposed combs can be pulled apart against the stretching force of the elastic strands before the hair accessory is inserted into the hair. The elastic strands provide a restoring force that will hold the hair accessory in place. The strands can be made of an elastic filament or cord, or elastic bands. Preferably, the elastic strand or strands are made of an elastic material that has a 3-to-1 or more stretch capability; however, use of strands having a lesser stretch capability are possible. Suitably, elastic cord can be used that is made of rubber covered with a woven textile material that prevents hair from sticking to the rubber. Other elastic materials could be used such as latex, silicone or a polymer resin.

It will be understood that the parallel configuration of elastic strands shown in FIG. 3 is for illustrative purposes only, and that other strand configurations could be used to interconnect the combs, including crisscrossed strands, partially crisscrossed strands, braided, looped, intertwined and strands of other types, materials, and shapes. Also, the strands can be decorated with various decorative elements, such as beads of various sizes and shapes, to provide an aesthetic quality to the hair accessory, or could be used without any decorative elements. Still further, it is contemplated a single comb in accordance with the invention could be used with elastic strands that form loops for use as a ponytail holder or the like.

As hereinafter described, the strands 13 of the dual comb accessory 11 are attached to the spines of the combs by various forms of strand connections. As further hereinafter described, this strand connections can be made by knotting or tying the ends of the strands or by attachment mechanisms that secure the ends of the strands in place on the combs. FIGS. 1-2 show an attachment mechanism in the form of terminal pins in the form of T-pins 14 that are secured to the ends of the strands such that the pins can be turned sidewise relative to the strands. T-pins 14 are suitably small tubes that can be slit longitudinally so that the ends of the strands can be inserted in the tube slits and tubes crimped onto the strand ends. It will be understood that attachment mechanisms other than the illustrated T-pin could be used. Examples of alternative attachment mechanisms will be described later in this specification.

Various embodiments of the novel comb of the invention are illustrated in greater detail in FIGS. 5-17. Each of these embodiments is characterized by a novel construction that allows the connecting strands 13 of the hair accessory 11 to be easily attached to the comb, and that allows the strand connections (knots, attachment mechanisms and/or strand segments running behind the spine) to be captured within or behind the spine above the combs radius of curvature, denoted by the letter R in FIG. 8.

FIGS. 5A-9 illustrate a preferred embodiment of the hair accessory comb of the invention. In these figures, the hair comb 15 includes a laterally extending spine 17 having raised portion comprised of a raised front edge wall 19 forming the leading edge of the spine, a top wall portion 21 extending rearward from the front edge wall, and a trailing edge wall 23 forming the trailing edge of the spine and terminating at a bottom edge 25. Walls 19, 21, and 23 are seen to form a raised cavity region 27 on the underside 29 of the spine into which connections can be tucked. A plurality of comb teeth 29 extend longitudinally from the front edge wall of the comp's spine 17, preferably along a curvature R that allows the combs to more or less conform to the curvature of the head of the wearer of the dual hair comb accessory. Preferably, the bottom edge 25 of the spine's trailing edge wall will extend downwardly a sufficient distance so that it also lies, or approximately lies, on the curvature R so that the comb bottom surfaces all follow the curvature of the wearer's head. However, this trailing edge wall could be of other lengths, preferably a shorter length so that the bottom edge 25 does not itself create a pressure point on the wear's scalp. (Indeed, as later described, the trailing edge could be eliminated altogether.) Also, the top wall portion 21 could be flat or rounded, or could even be a point formed by intersecting leading and trailing edge walls.

Because of the curvature of the comb, opposed combs 15 of the dual comb hair accessory 11 shown in FIGS. 1 and 2, when worn, will lie more or less flat against the scalp with the elastic strands 13, which stretch across the hair, pulling on the combs to hold them in place.

To connect the strands of material to the spine of comb 15, such as the elastic strands 13 of the dual hair comb accessory 11 shown in FIGS. 1 and 2, the spine is provided with a series of strand openings 31 through which the connecting strands can be threaded. Preferably, these strand openings are provided, at least in part, in the front edge wall of the spine where they are raised above the level of the comb teeth and are oriented (at least in part) at an angle that is pitched up from the plane of the comb. The raised and pitched-up strand openings advantageously raises the strands relative to the plane of the combs and changes the way the tension exerted by the stretched elastic strands pull on the combs. Instead of pulling on a flat spine along the plane of the comb, the strands exert a pulling force from an elevated position. They also pull against a raised wall which inclined upwardly relative to the curved plane of the comb.

The above-described raised spine construction of comb 15 has still further advantages. In conventional plastic hair combs, the spine is substantially flat and prone to breakage. To resist breakage the comb spine is normally made to be relatively wide thereby producing a relatively bulky looking comb. The raised spine can provide a U-shaped, or partial U-shape spine construction having relatively high structural integrity and allows a narrower and thus relatively unobtrusive spine to be used without sacrificing durability. Also, the raised cavity region 27 on the underside of the spine allows strand connections, such as knots or attachment mechanisms as hereinafter described, to be tucked away in the spinal structure where they cannot escape or be seen.

The number of strand openings 31 in the comb spine 15 can vary depending on the intended use of the comb or the desired design of a dual comb hair accessory in which the comb is used. Suitably there would be two or more openings for entry points for two or more connecting strands or strand segments threaded between opposed combs (or to allow two ends of a single strand to connect to the comb). Preferably, these openings would be evenly distributed across the length of the spine to provide a balanced hair accessory, however, an unbalanced strand distribution would be possible and considered within the scope of the invention. A single opening would also be possible, including an elongated opening or openings extending along the length of the spine. It is also contemplated that openings of varied sizes can be used.

In the embodiment illustrated in FIG. 5A-9, strand openings 31 are seen to be provided between the endmost comb teeth 27*a* and their adjacent teeth 27*b* and then evenly distributed between successive pairs of comb teeth 27*c* and 27*d* separated by a single comb tooth 27*e*, 27*f* and 27*g*, with comb tooth 27*g* being the center tooth of the comb. Adjacent comb teeth are seen to form short and long comb teeth separation channels 33, 35, with the strand opening 31positioned behind the short separation channels 33, and with the longer separation channels 35 extending up into the front edge wall of the spine of the comb between the strand openings. Because hair will flow into the extended length of these longer channels—which can for example extend into the spine by about ¼ inch—the longer channels will permit secure placement of the hair accessory in the hair with greater stability and comfort.

In the illustrated embodiment, a spacing for the strand openings on the spine is selected to provide two long channels between each strand opening and its associated short channel, resulting in a comb having a high percentage of long channels and a good distribution of points on the spine through which connecting strands can be threaded. Also, the distribution produces a short channel next to each of the outside teeth 27*a* of the comb, which are preferably wider than the comb's interior teeth 27*b* -g. It is believed that providing relatively wide outside teeth along with a channel distribution that places the short channel next to the wider outside teeth of the comb enhances the stability of the comb in the hair.

With further reference to FIGS. 5A-9, when viewed in side elevation it is seen that the thickness of each of the comb teeth, as denoted by the letter T in FIG. 9, is relatively uniform over the length of the comb and that the comb teeth terminate at rounded ends 37. When seen in from the top plan view, the interior long edges 39 of the comb teeth are seen to taper inwardly as you move toward the spine of the comb. Thus, the comb teeth are widest at the base of the teeth and narrow at the rounded ends so that the rounded ends are relatively far apart. By keeping the ends of the comb teeth far apart, the teeth will tend to flow through the hair more uniformly.

While the above-described shape and spacing characteristics of the teeth of the comb of the invention are preferred and have particular advantages, it will be understood that the invention is not limited to combs having comb teeth with these characteristics. Hair combs having a raised spine in accordance with the invention could be provided with comb teeth of other shapes and having other spacing characteristics, such as parallel teeth having closely spaced tips or staggered rows of teeth, and could have a greater or fewer number of teeth than shown. The ends of the teeth could also be pointed, flat, square or coated with another material such as rubber or silicone.

The comb of the invention can be readily and inexpensively fabricated as a molded plastic part using plastics found in conventional hair combs. It would most suitably be fabricated of a durable plastic, such as PET, ABS plastic or polystyrene, but could be made of other materials. For example, it is contemplated that the combs could be made of stamped metal, or could have a metal spine and wire loop teeth. The dimensions of the comb can vary depending on its intended application. Generally, it is contemplated that combs in accordance with the invention can be provided in different sizes, with the width of the comb, denoted by the letter W in FIG. 6, suitably ranging 1½ to 3½ inches, and the length of the spine, denoted by "L" in FIG. 6, suitably ranging from 1 to 4½ inches. A suitable comb thickness (thickness "T" in FIG. 9) would suitably be in the range of 0.1 inches. In the embodiment shown in FIGS. 5A-9, this thickness is seen to be substantially uniform over the entire comb from the ends of the teeth to the bottom edge of the trailing edge wall of the spine. It will be understood that combs having dimensions other than indicated above are possible and within the scope of the invention.

As above mentioned, strands of material, typically elastic strands, can be attached to the spine of the comb in various ways. Desired strand configurations could be accomplished using a single strand by weaving the single strand between the desired strand openings of the comb or combs and attaching the end points of the strands at the comb spine or spines, such as by knotting or via an attachment mechanism. Or this could be accomplished using multiple strands.

In FIGS. 1 and 2 the attachment of multiple strands 13 to combs 15 to form the dual comb hair accessory 11 is shown and is accomplished by simply holding the ends of the strands and pushing the terminal T-pins 14 through the desired strand openings 31 in the raised portion of the comb's spine 17, as denoted by the arrow A in FIG. 1, and pulling the strand end back so that the T-pin lodges in a rotated position against the back of the opening, where it will be tucked up into the raised cavity region 27 of the raised spine 27 of the comb, as shown in FIG. 2. If desired, the end of the elastic strand can be threaded down through one strand opening, run along the underside of the spine, and then threaded up through another strand opening on the same comb, whereupon it can be stretched to the opposed comb for threading through a strand opening in the opposed comb. This back-and-forth threading process can be continued until being terminated by simply allowing the T-pin on the threaded end to rotate behind the last strand opening through which the strand end is threaded. During this process, the strands can be threaded with beads or other decorative elements for form a decorative pattern of woven or straight strands between the combs.

Referring to FIGS. 10A-14, a hair comb is shown having an alternative design for the raised spine of the comb. Here, the spine 43 of hair comb 41 has a raised portion comprising a raised front edge wall 45 that rises up from a flat front shoulder portion 46 that forms the leading edge of the spine, and a bent over top wall portion 47. Unlike the embodiment shown in FIGS. 5A-9, the spine of this version of the comb has no trailing edge wall, and thus produces a raised cavity 49 on the comb's underside 51 that is open in the back. A plurality or elongated strand openings 53 extend from the spine's leading shoulder portion up into the raised front edge wall with one strand opening being provided behind each separation channel 55 for the longitudinal comb teeth 57. In this case the strand openings 53 through which elastic strands can be threaded are virtual extensions of separation channels 55 and provide a greater number of strand connection points for the strands. As in the previously described embodiment, the raised cavity region of the spine structure will accommodate the tied or fastened ends of connecting strands and strand segments situated beneath the spin. Also, as in the prior embodiment, the strand openings are elevated relative to the curved plane of the comb, thus providing for elevated strand connections for improved stability.

In the embodiment of the invention shown in FIG. 15, the hair comb 59 is similar to the hair comb 41 shown in FIGS. 10A-14, except the strand openings 61are located on the top wall 63 of the comb's spine 65. This location of the strand openings elevates the connection points for the strands to the top of the raised spine, but does not have the advantage of producing a pulling force on a structure part of the spine that is inclined relative to the curved plane of the comb.

FIG. 16 illustrates a hair comb (comb 67) similar to the embodiment shown in FIGS. 10A-14, including a similar placement of the strand openings on the front edge wall 69 of the raised spine 71, but with fewer strand openings. In this embodiment the strand openings 72 are seen to be less elongated, and unlike the version shown in FIGS. 10A-14, they do not extend into the spine's front shoulder portion 73.

Figure 17:
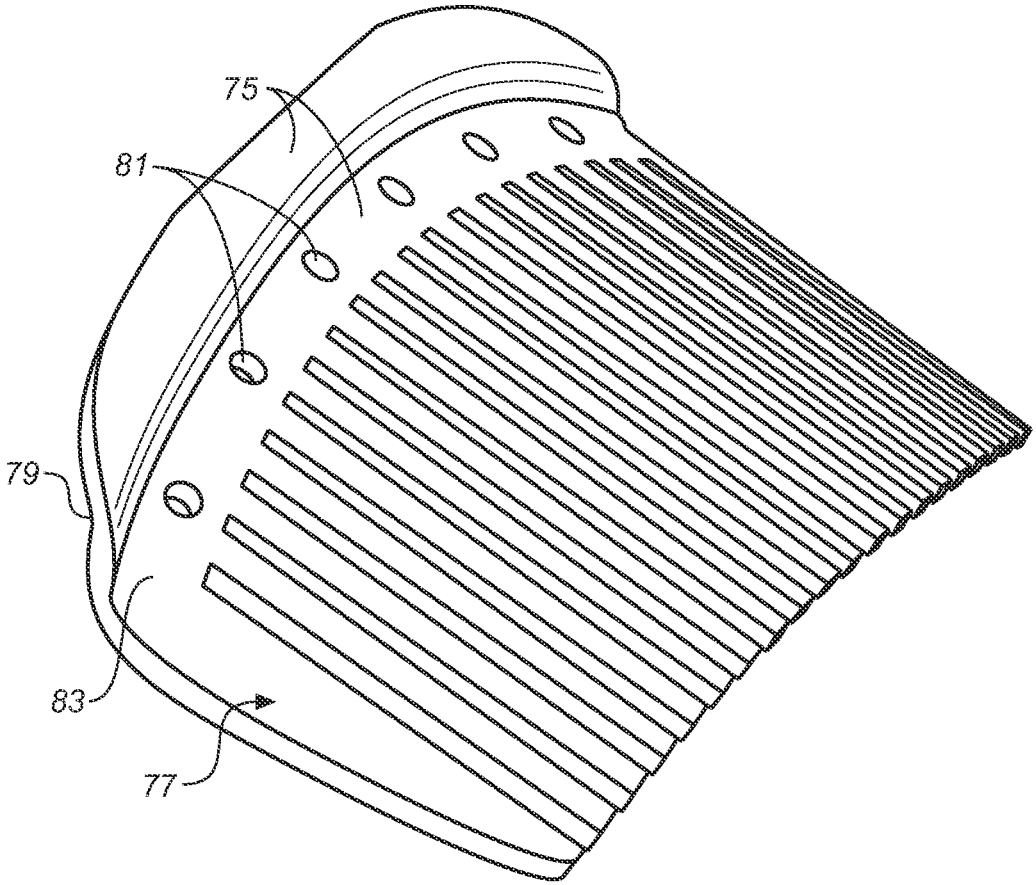
FIG. 17 is a top perspective view of still a further embodiment of a hair comb in accordance with the present invention.

Yet another possible embodiment of the hair comb of the invention is shown in FIG. 17. Here, the raised spine 75 of hair comb 77 is similar to the open raised spines of the embodiments disclosed in FIGS. 10A-16, except the raised portion 79 of the spine contains no strand openings. Rather, in this embodiment, the strand openings 79 are placed in front of the raised portion of the spine on the spine's front shoulder portion 81. This location of the strand openings relative to the raised portion of the spine is considered to be the least desirable location since it would produce a dual comb hair accessory that would be less stable when worn. Nonetheless, the raised portion of the spine would allow strand ties or fastening mechanisms and segments of strands running along the spine to be tucked up into the raised cavity on the underside of the spine.

It will be appreciated that other version of the hair comb of the invention are possible which are not specifically illustrated and described herein. For example, the raised portion of the spine could be comprised of a leading or raised edge wall only, without a bent over top wall portion or a trailing edge wall. In such an embodiment, strand openings could be provided in the raised edge wall thereby advantageously elevating the strand openings and connection points for the strands. Strand knots or attachment mechanisms would be tucked behind the raised edge wall and also raised so as to prevent pressure points from being produced by the connections on the wearer's head. A cavity region could be provided on the back of such a raised edge wall into which the strand connections could be tucked.

In another possible embodiment (not shown), the raised portion of the spine could be two or more raised spinal sections which are not continuous along the length of the spine. This would create gaps, such as flat portions of the spine, between the raised spinal sections. The raised spinal sections would in turn create non-continuous raised cavity portions on the underside of the spine for receiving stand terminations or connections.

Figure 18:
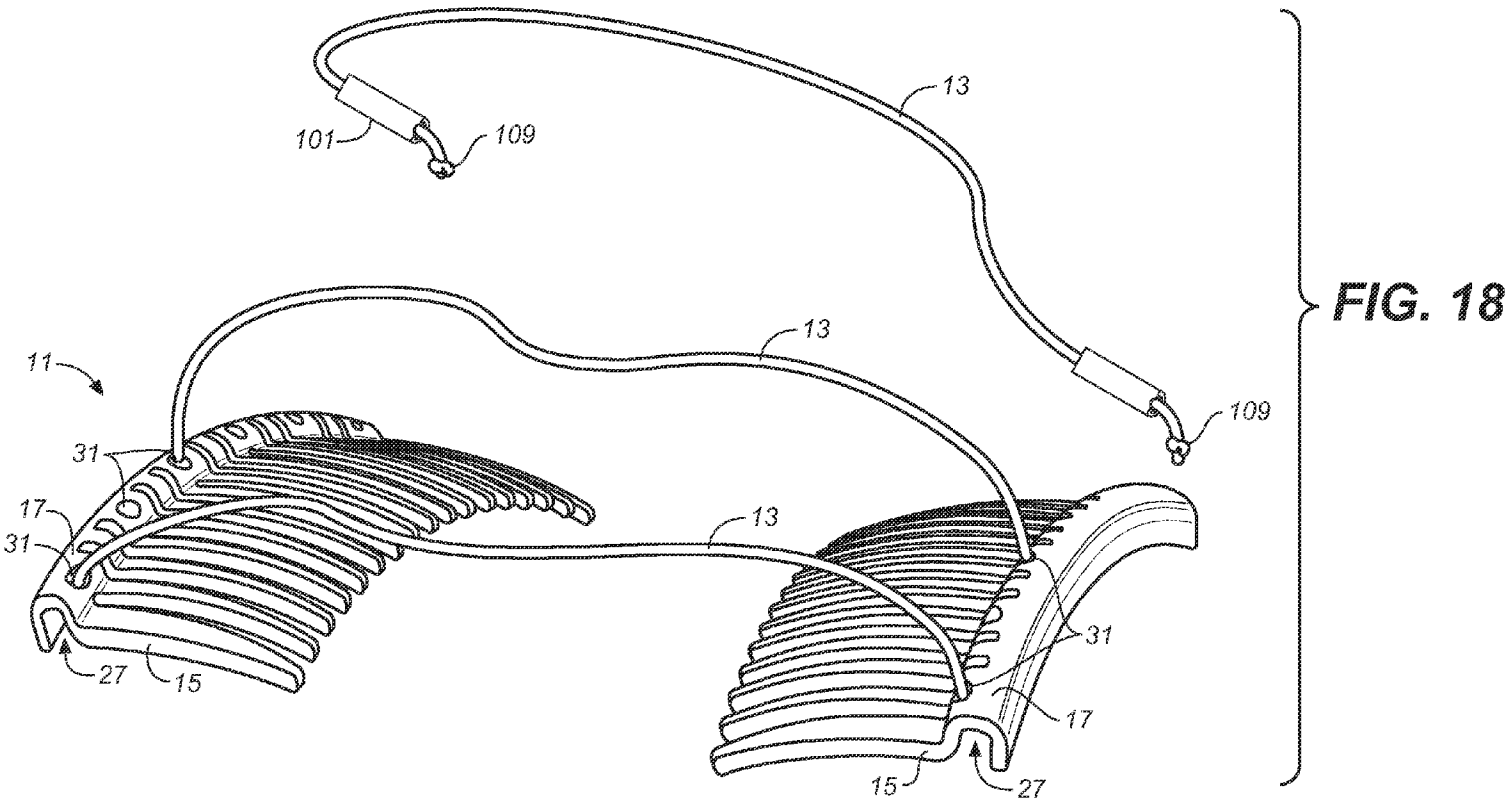
FIG. 18 shows a dual comb hair accessory as illustrated in FIG. 1, but with alternative strand attachment mechanisms in the form of spine cavity plugs for retaining the ends of strands of the hair accessory to the spines of the combs.
Figure 19A:
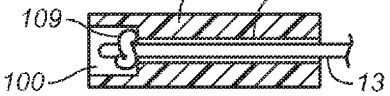
FIG. 19A is a cross-sectional view of one of the spine cavity plugs shown in FIGS. 18 and 19 affixed to an end of a connecting strand of the hair accessory.
Figure 19:
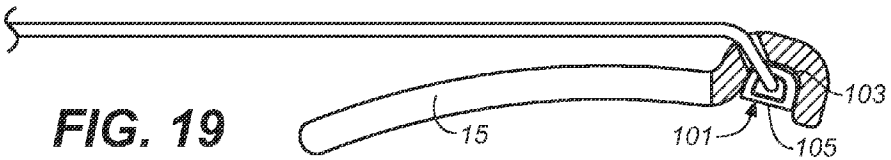
FIG. 19 is a cross-sectional view of one comb of the dual hair accessory shown in FIG. 18 after the strands of material have been attached to the combs of the accessory and showing the spine cavity plugs snugly fitted into the raised cavity regions of the spines of the comb.
Figure 20:
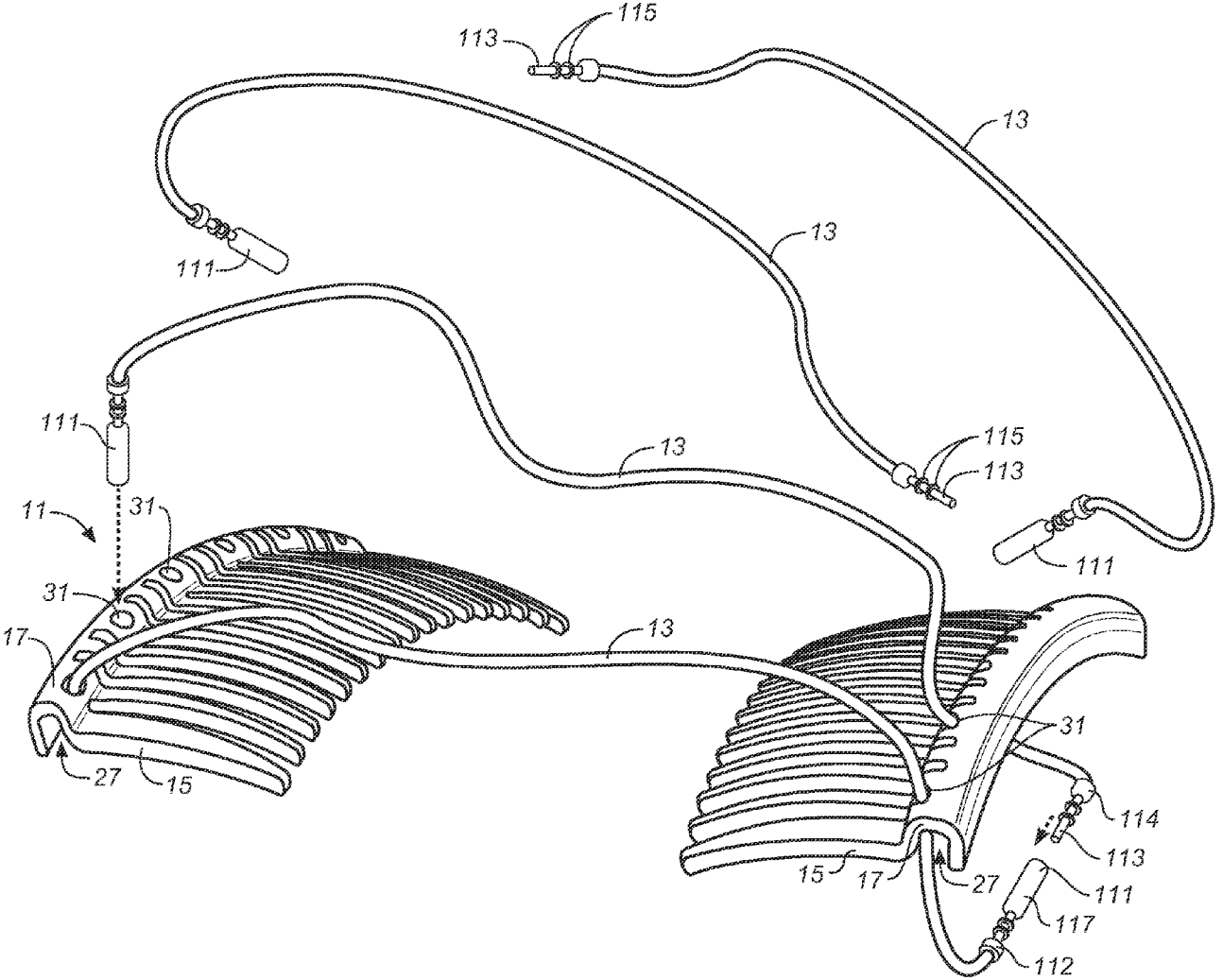
FIG. 20 shows a dual comb hair accessory as illustrated in FIGS. 1 and 18, with another possible attachment mechanism for retaining the ends of strands of the hair accessory.

FIGS. 18-20 illustrate alternative attachment mechanisms for the securing the ends of the strands of the dual comb hair accessory 11. In FIGS. 18, 19, and 19A, the attachment mechanisms are provided on the form of spine cavity plugs 101. The plugs 101, which are suitably made of a soft rubber or plastic material, preferably have a half round shape, and are sized such that the plug's curved side 103 fits snugly in the raised cavity region 27 on the underside of the spines 17 of combs 15. When a plug 101 is pressed by hand into the spine cavity 27 of one of the combs 15, the plug's flat side 105 will remain tucked within the cavity 27 so that the plug does not protrude from the underside of the comb and press on the wearer's scalp. The length and width of the plug should be large enough such that, when pressed into the spine cavity, it will be retained in the cavity until it is forced or "popped" out of the cavity by a prying force exerted by the user, such as by the user's finger.

As best seen in FIG. 19A, the plugs 101 can be attached to the ends of the strands 13 by threading the ends of the strands through a hole 107 that extends the length of the plug, and then knotting the strand ends. This is done after the strands are threaded through the comb's strand openings in a desired strand configuration, for example, in a parallel or crisscross configuration. Once the spine cavity plugs are installed on the strand ends and the strand ends knotted, the plugs are slid firmly up against the strand's knotted ends. Preferably, one end to the plug hole 107 is enlarged to form a recess 109. Thus, by orienting the plug so that its recess end faces the knot 109 made at the end of the strand, the knot can be pulled into the recess. This not only hides the knot, it also prevents the knot from hanging outside of the plug where it might lodge between the scalp and the plug, or between the scalp and the underside of the comb.

It is noted that, instead of threading the strand ends through the plugs 101, the plugs could simply be pressed into the spine cavity 27 over the ends of the strand to keep the strand ends tucked into the spine cavity. Preferably, the strand ends would be knotted before doing this to prevent the strands from pulling out of the spine.

FIG. 20 shows yet another attachment mechanism for the strands of the dual comb hair accessory 11. In this embodiment, the ends of the strands 13 are provided with strand end connectors that can be connected together behind the spines of the combs 15. One end of the strands has a female connector element 111 and the other end has a male connector element 113, and at least one and preferably both of the connector elements have a sufficiently small profile that allows the connector elements to be inserted through the combs' strand openings 31. The male connector 113 has a base 114, which has an opening (not shown) for receiving the strand ends, and to which strand ends can be attached such as by crimping the base onto the strand ends. The female connector element similarly has a base end 112 for attachment of this connector element to the other ends of the strands. The male and female connectors are designed such that the user can insert the projecting end of the male connector into the female connector without male connector pulling out of the female connector during use, but such that the connectors can be later separated by the user. In the version of the connector shown in FIG. 20, the male connector is provided with a metal barbed end 116 (with metal barbs 115) that fits into a sheath end 117 of the female connector element, which is suitably fabricated of a soft material such as latex. The barbs of the male connector will stick in the soft sheath with enough holding force to keep the ends joined during use. It will be understood that connectors types and configurations other than illustrated in FIG. 20 could be used, including snap connectors and hook and loop fastener such as Velcro®.

Once the strand ends are connected together behind the spine of one of the combs as shown by the arrow in FIG. 20, the strand connections can tucked up into the cavity 27 formed on the underside of the spine. Thus, the strand end connections will not protrude below the plane of the comb where it could press against the wearer's scalp. It will be appreciated that the strand end connectors can be used to the attach strand ends of both multiple short strands behind each of the comb as shown in FIG. 20, or they can be used to attach the ends of one or a few longer strands that are threaded back and forth between the combs. For example, a relatively long single elastic strand having complimentary connectors at each end could be threaded back and forth between the combs' strand openings such that the two connector ends both emerge in the cavity region 27 behind the raised spine of the same comb. (Again, at least one of the connectors must be sized to fit through the strand openings of the combs.) Here they can be joined together to secure the strand ends, and the single strand connection can be tucked into spinal cavity of the comb behind which the connection is made. The raised cavity region on the underside of the spine allows the segments of the single strand that run behind the comb spines when it is threaded back-and-forth between the combs to be tucked into the spine.

While the present invention has been described in considerable detail in the forgoing specification and the accompanying, it shall be understood that it is not intended that the invention be limited to such detail, except as necessitated by the following claims.

What we claim is:

1. An improved hair comb for a hair accessory having strands of material that attach to and extend from the hair comb, said hair comb comprising a laterally extending spine having a top side, an underside, a leading edge, and a trailing edge, said spine further having a raised portion along its length which forms a raised cavity region on the underside of said spine into which strand connections can be tucked, the raised portion of said spine being formed by a raised front edge wall that extends upwardly from the spine and a top wall portion extending rearward from said raised front edge wall, said raised cavity region being formed at least in part by said front edge wall and top wall portion, a plurality of strand openings provided along the length of said spine and strands of material threaded therethrough, wherein said strand openings are provided, in part, in the raised front edge wall of the raised portion of said spine and wherein said strand openings extend from the front edge wall of the raised portion of said spine into the top wall portion of said raised portion, and a plurality of teeth extending longitudinally from the leading edge of said spine.

2. The improved hair comb of claim 1 wherein comb teeth separation channels are formed between adjacent teeth of the comb, wherein said separation channels include long comb teeth separation channels that extend into at least the front edge wall of the raised portion said spine and at least one short comb tooth separation channel between long comb teeth separation channels, and wherein said strand openings are positioned between long separation channels.

3. The improved hair comb of claim 2 wherein said long separation channels extend into the top wail of the raised portion of said spine.

4. An improved hair comb for a hair accessory having strands of material that attach to and extend from the hair comb, said hair comb comprising a laterally extending spine having an underside and a raised portion formed at least in part by at least one upwardly extending front edge wall and a top wall portion extending rearward from said front edge wall, wherein said front edge wall and top wall portion form a raised cavity region in and open to the underside of said spine into which strand connections can be tucked, strand openings provided along the length of said spine and strands of material threaded therethrough, at least one strand opening being provided, in part, in the upwardly extending front edge wall of the raised portion of said spine and wherein the at least one strand opening in the upwardly extending front edge wall of the raised portion of said spine extends from the front edge wall of the raised portion of said spine into the top wall portion thereof, and a plurality of teeth extending longitudinally from the said spine on the side of the front edge wall thereof.

5. The improved hair comb of claim 4 wherein each of said strand openings is provided, in part, in the upwardly extending front edge wall of the raised portion of said spine, and wherein each of said strand openings in the upwardly extending front edge wall of the raised portion of said spine extends from said front edge wall of the raised portion of said spine into the top wall portion thereof.

6. The improved hair comb of claim 4 wherein the cavity region on the underside of the spine extends substantially the length of the raised portion of the spine, such that strands or strand connections can be tucked into said cavity region when said strand or stands of material are threaded through the stand openings in the raised portion of the spine.

7. The improved hair comb of claim 4 wherein said strand openings are evenly distributed across the raised portion of said spine.

8. The improved hair comb of claim 4 wherein said extending teeth have a base and an extended end and are characterized by a width and a thickness, and wherein the thickness thereof is substantially uniform over substantially the entire length thereof.

9. The improved hair comb of claim 8 wherein ends of the teeth are rounded.

10. The improved heir comb of claim 8 wherein the width of said teeth decreases at a substantially uniform rate from the base of the teeth to the ends of the teeth.

11. The improved hair comb of claim 4 wherein comb teeth separation channels are formed between adjacent teeth of the comb, wherein said separation channels include long comb teeth separation channels that extend into the raised portion of said spine and at least one short comb teeth separation channel between long comb teeth separation channels, and wherein said strand openings are positioned on the raised portion of the spine between the long comb teeth separation channels.

12. The improved hair comb of claim 11 wherein one or more long comb teeth separation channels alternate with at least one short comb teeth separation channel and wherein strand openings are provided in the raised portion of the spine behind short comb teeth separation channels and between the long comb teeth separation channels.

13. The improved hair comb of claim 11 wherein a strand opening is provided behind each short comb teeth separation channel.

* * * * *